US006582203B2

(12) United States Patent
Herrmann et al.

(10) Patent No.: US 6,582,203 B2
(45) Date of Patent: Jun. 24, 2003

(54) RADIAL PISTON PUMP

(75) Inventors: Michael Herrmann, Lebach (DE); Wolfgang Rapp, Neukirch (DE)

(73) Assignee: ZF Batavia, L.L.C., Batavia, OH (US)

( * ) Notice: Subject to any disclaimer, the term of this patent is extended or adjusted under 35 U.S.C. 154(b) by 0 days.

(21) Appl. No.: 09/853,139

(22) Filed: May 10, 2001

(65) Prior Publication Data

US 2002/0001525 A1 Jan. 3, 2002

(30) Foreign Application Priority Data

Jun. 2, 2000 (DE) ..... 100 27 425

(51) Int. Cl.[7] ..... F04B 1/04; F04B 27/04

(52) U.S. Cl. ..... 417/273; 417/284; 417/307; 417/545

(58) Field of Search ..... 417/273, 284, 417/440, 470, 290, 307, 310, 312, 269, 554, 545, 546, 547, 292, 252; 181/272, 237, 238

(56) References Cited

U.S. PATENT DOCUMENTS

| | | | | |
|---|---|---|---|---|
| 4,975,025 A | * | 12/1990 | Yamamura et al. | 417/273 |
| 5,213,482 A | * | 5/1993 | Reinartz et al. | 417/273 |
| 5,354,181 A | * | 10/1994 | Porel | 417/269 |
| 5,628,625 A | * | 5/1997 | Dokas | 417/523 |
| 6,334,762 B1 | * | 1/2002 | Hauser et al. | 417/569 |

FOREIGN PATENT DOCUMENTS

| | | | |
|---|---|---|---|
| DE | 1 170 785 | | 5/1964 |
| DE | 41 31 033 A1 | | 3/1993 |
| DE | 42 41 825 A1 | | 6/1994 |
| DE | 43 36 673 A1 | * | 5/1995 |
| DE | 43 38 641 A1 | | 5/1995 |
| DE | 197 56 727 A1 | | 5/1999 |
| DE | 43 36 673 C2 | | 8/1999 |
| JP | 5-302566 A | * | 11/1993 |
| JP | 5-302566 | * | 11/1993 |
| JP | 9-004559 | * | 1/1997 |

* cited by examiner

*Primary Examiner*—Charles G. Freay
*Assistant Examiner*—Han L. Liu

(57) ABSTRACT

The invention is based on a radial piston pump (1) with a pump body (2), in which pump body (2) are placed pistons (4), and cylinders (5) arrayed radial to a cam (14) and the pistons (4) upon an inward thrust suck in fluid by means of suction side intakes (17) and upon an outward thrust, the pistons (4) impel fluid through pressure openings (7) in the outer end walls (6) of the cylinder (5) into a plenum (10). It is proposed, that in the base of the cylinders (4) respectively a connection boring (32) is made to the cam (14), which connection boring (32) is controlled by a relief valve (18). Upon the exceeding of its opening pressure the relief valve (18) opens and pressure peaks in the cylinder (5) can be diminished by means of said connection boring. At the same time, a pressure buffer between the base of the piston (4) and the bearing shell (16) is formed.

7 Claims, 2 Drawing Sheets

RADIAL PISTON PUMP

Figure 1:
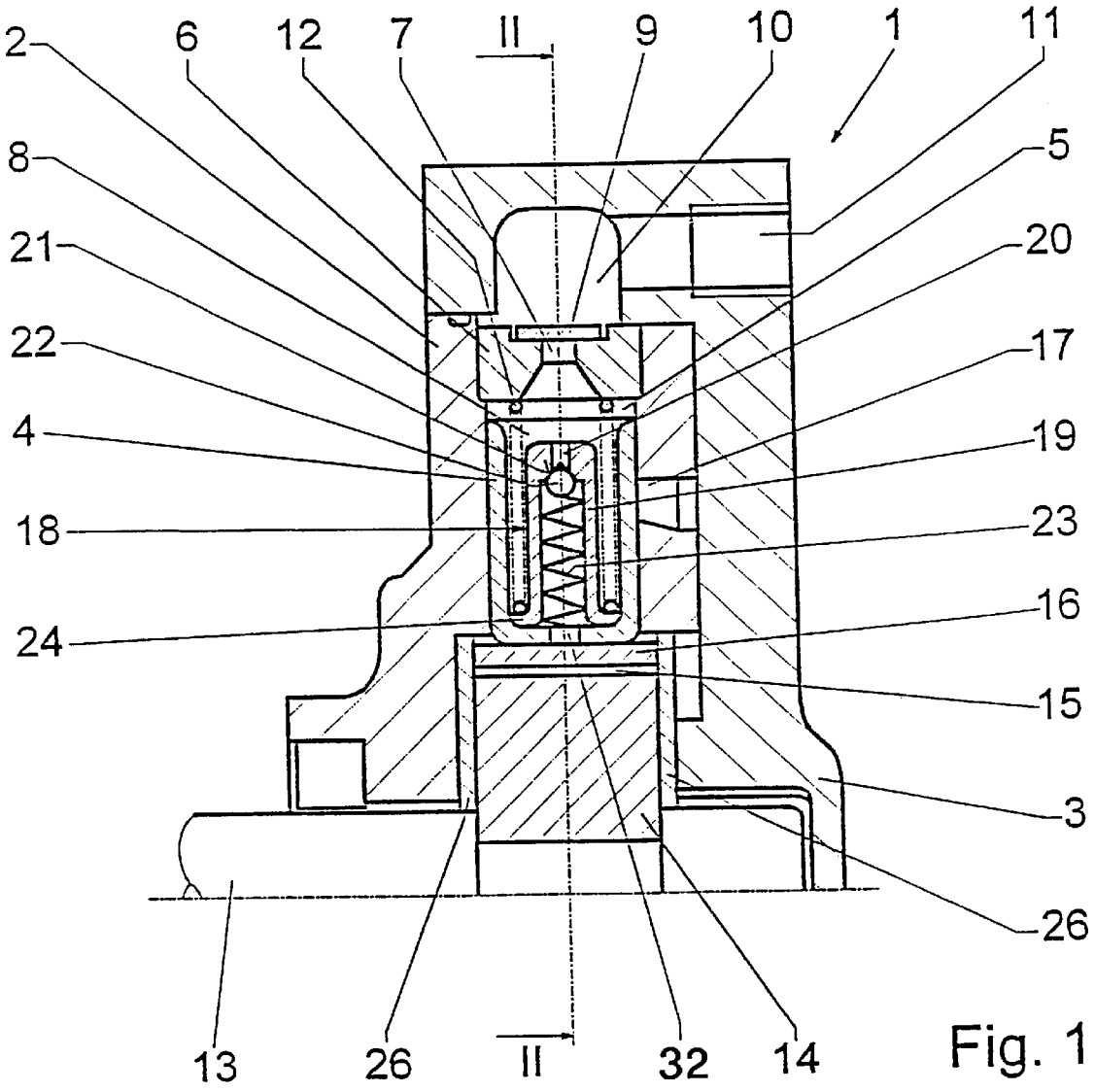

The invention concerns a radial piston pump in accord with the generic concept of claim 1.

Radial piston pumps are, among other types of pumps, employed in motor vehicles, for lubrication medium pumping in internal combustion engines and transmissions. Further applications are found in pumps for hydraulic positioning members, steering joints, springs, couplings, stepless drives, automatic controlled transmissions, hydraulic driving aids, auxiliary drives, concrete mixers, and the like. These pumps characterize themselves as particularly adaptable in installations wherein high pressures are involved.

Classified as positive displacement pumps, these pumps transport the pressure medium, not in continuous flow, but non-uniformly in increment volumes per rotation of an eccentrically centered drive cam. The cyclically transported volumes bring about, both on the suction side as well as on the pressure side, variations in pressure, pressure oscillations, or pulsations. These pressure variances are superimposed on intake and output impulses, which, arise by the opening and closing of the transport chamber. The pulsations are especially great, if during the use of inlet or outlet valves of the coil spring type, application volumes with large pressure variations are suddenly connected. Further, intense pressure swings may occur, if the pressure in the system is high or the cylinder is only partially filled.

When the pressure in a cylinder attains such a pressure as to trigger the opening of the annular coil spring closure element, then this element rises from its seating in the area of the respective cylinder and the hydraulic medium, i.e. the hydraulic fluid, is forced into the plenum. If the pressure in the cylinder falls under the closure point of the coil spring valve, then the respective closure element is forced back onto said seat and thereby causes a loud hammer sound. This procedure repeats itself for each rotation of the drive cam, and as often as the number of the piston-cylinder units in the pump.

The said noise is just so much louder, the more dynamically the opening and closing process runs, that is, in accord with how great the ratio is between the pressure at opening and closing and further, in accord with the slope of the pressure increase curve from the instant of the opening. If these several values run very high, then the coil spring of the valve is lifted distant from its seat very quickly and subsequently strikes accordingly hard on said seat upon its return.

DE 43 38 641 A1 discloses a generic radial piston pump, which possesses a pump body with cylinders closed off by plugs. In the plugs are found pressure channels, which are covered by a slotted coil spring which encompasses the body of the pump. Upon the rotation of the drive cam, the pistons are set into a thrust movement and force the already drawn in hydraulic fluid through the said pressure channels into an annular plenum on the other side of the coil spring valve, and do this as soon as the pistons close the intake entry port. Upon the ejection of the hydraulic fluid, and after the closing of the intake port, pressure peaks occur in the cylinder, which again produce a hammer sound and so stress the bearing shell inserts between the respective pistons and the drive cam.

DE 42 41 825 A1 describes another radial piston pump, in which, by the purposeful incorporation of elasticity in the piston, that is, on the connection between the piston and a needle bearing, the pressure and force gradients are diminished and the noise intensity is alleviated. DE 43 36 673 C2 makes known a radial piston pump, in which an annular spring is installed which encompasses the drive cam. The said spring is installed on the sliding element (bearing shell) between the drive cam and the piston. The pistons thus springingly support themselves in this arrangement on the drive cam, so that, upon the beginning of the expulsion stroke, the pistons relax the start of thrust, so that the pressure peaks are diminished.

Thus the invention has the purpose of reducing the noise and ameliorating the bearing stress. This purpose is achieved, in accord with the invention, by the features of claim 1. Additional embodiments arise from the subordinate claims.

In accord with the invention, in the base of the pistons, respectively, a connection boring to the drive cam has been placed, which is governed by a high pressure relief valve. Should the pressure in the cylinder exceed the opening pressure of the relief valve, then this will open so that hydraulic fluid escapes, and thereby, pressure peaks are reduced. At the same time, the escaping hydraulic fluid from the said connection boring, creates an hydraulic fluid buffer on the underside of the piston base, between this and the drive cam, that is to say, between the piston base and the bearing shell on the cam. This fluid pressure buffer acts to dampen the noise.

In an advantageous manner, the said relief valve can be installed in a hollow interior of the piston, which is open toward the pressure port. The relief valve is inset in the enveloping valve body which covers the connection boring. This body possesses a valve boring with a valve seat, which coacts with a closure element, by which the valve boring in the direction of the hollow space is shut off from the plenum. If the motion of the closure element is directed radially, then, inertial forces act upon said element, which forces are dependent upon the acceleration of the piston.

In accord with one embodiment of the invention, the proposal is made, of controlling the relief valve by means of these acceleration forces which act upon the closure element. This would be done in such a manner, that the opening, i.e. the closing, of the relief valve is carried out at the correct point in time. The opening of the relief valve is done, in this way, preferably shortly after piston movement passes the lower dead point and this opening initiates the diminution of the pressure peak. Correspondingly, the closing of the relief valve is done advantageously shortly after the passing of the upper dead point of piston movement, whereupon the intake suction procedure begins.

In a further development in this matter, the proposal is made, that the closure element is to be of such a mass, that the acceleration forces in the range of the lower dead point exceed the pressure forces in the cylinder, and in an upper dead point, such forces are diminished. Thereby, the connection boring is closed during the inward thrust of the piston, so that the full inlet suction pressure is achieved, while during the outward thrust the pressure peaks in the cylinder exceed the acceleration forces which are acting on the closure element in the closing direction. When this occurs, the relief valve opens and said pressure peaks are diminished.

In addition to the acceleration forces, the closure can be loaded by a valve spring. By means of such a spring, the opening and closing behavior of the relief valve can be modified. If the closure element is so placed, that it moves in a direction transverse to the direction of piston thrust, then a spring is necessary since no perceptible inertia exists.

In order to modify the speed at which the pressure peaks are diminished, it is of advantage, to design the valve boring and/or the connection boring to act as an orifice. Since the action of an orifice changes with the viscosity and with the temperature of the hydraulic fluid, it is a practical matter to be able to change the cross section of the said orifice boring correspondingly with the temperature, so that over large temperature ranges pressure peaks are ameliorated in the same manner.

The valve body can be inset in an optional manner into the piston. For instance, the valve body can be screwed in, welded in, pressed in as force fit or the like. In an advantageous design, the valve body possesses an outward flared rim which lies on the base of the piston, and on which one end of a piston spring abuts. With the other end, the piston spring supports a plug, which separates the cylinder from the plenum. Thus, the valve body is fixed by said piston spring between the plug and the piston base.

Further advantages arise from the following description with the aid of the drawings. An embodiment of the invention is presented in the drawing. The description and the claims embrace a multitude of features in combination.

The expert in this given technology will, in practicality, observe the features in their individual state and combine them into further significant combinations.

Figure 2:
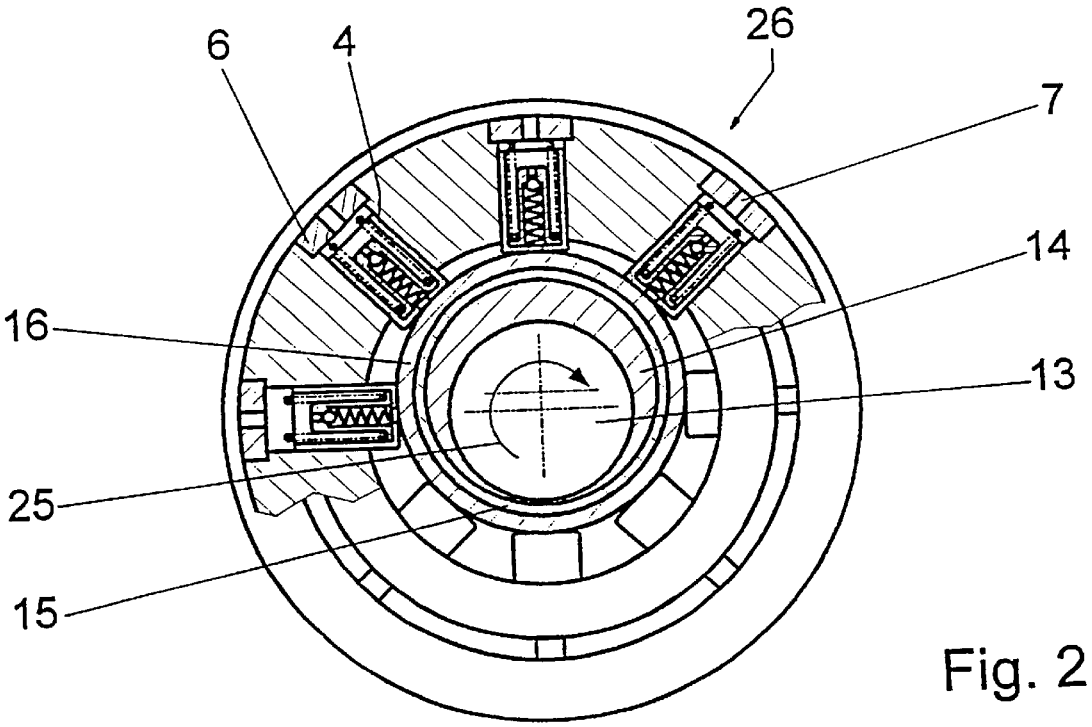
Figure 3:
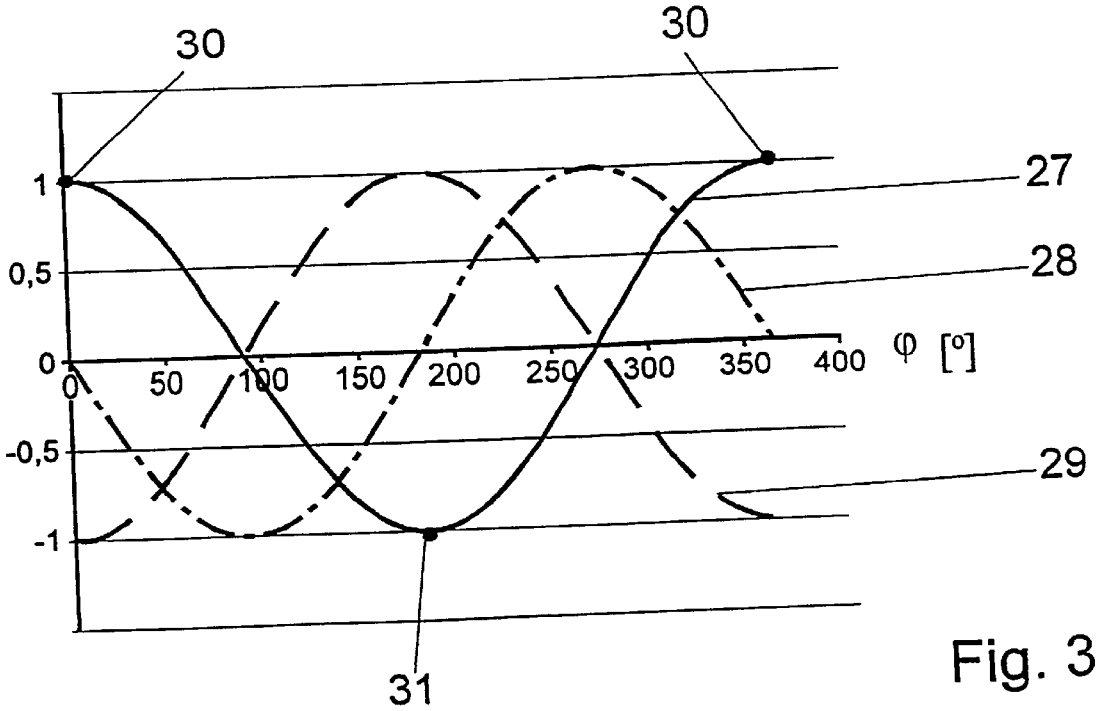

There is shown in:

FIG. 1 an upper half of a longitudinal section through a radial piston pump in accord with the invention, FIG. 2 a partial section, corresponding to the section line II—II of FIG. 1, and FIG. 3 a diagram presenting in curve form the thrust, speed and acceleration characteristics of the piston.

The radial piston pump 1 possesses a pump housing 3, into which a pump body 2 has been inserted and sealed. Pistons 4 and cylinders 5 form piston-cylinder units which are radially arrayed in the pump body 2. The pistons 4 reciprocate by a driven eccentric cam 14, which is affixed to the drive shaft 13 or possibly formed thereon. The cam 14, which is guided in the pump housing 3 between two axial guard disks, is encompassed by a damping ring 15, upon which a bearing shell 16 is seated. These bearing shells 16 are comprised of an appropriate raw material, which assures a minimum of abrasion and a maximum of operational life. The damping ring 15, which can be in the form of an annular bellows-like spring, damps the pressure oscillations acting on the piston 4.

The cylinder 5 is closed in the direction of the circumference of the pump body 2 by a plug 6, which is inserted in the pump body 2 and possesses a pressure port 7, which allows the cylinder 5 to communicate with a plenum 10 in the pump housing 3.

Leading from the plenum 10 is a connection fitting 11 for an outlet to equipment (not shown) using the hydraulic fluid under pressure. The internal pressure port 7 is capped by a coiled annular valve spring 9, which lies upon a seat of the plug 6, and in accord with the particular pressure relationships, closes or opens the flow through pressure port 7.

The pistons 4, which possess, respectively, a hollow space 8 opening toward the pressure port 7, execute respectively both an outward and an inward thrust during one revolution of the cam 14, which turns in the direction of rotation 25.

As this takes place, the affected pistons 4 are pressed sequentially against the bearing shell 16 by piston spring 12. Upon the outward thrust, a respective piston 4 closes off the suction side intake port 17 with its end rim. As the said suction side intake port 17 is closed off and the check valve 18 shuts, the filling cycle of the cylinder 5 is ended. Now the pressure in the cylinder 5 rises to such a level that a pressure threshold is reached at which the annular, coiled, valve spring 9 is lifted from its seat in the respective area and the pressure opening 7 of the respective piston opens, so that hydraulic fluid from the cylinder 5 can be forced into the plenum 10.

In order to lift the annular, coiled, valve spring 9, the pressure against the opening multiplied by its effective area must overcome the system pressure in the plenum 10 multiplied by its effective area plus the resident force of said annular, coiled valve spring 9. During the period of the closed pressure port 7, the active area diminishes itself to the cross sectional area of said port 7 and possibly to the circumferential areas of bordering, relieving undulations. Because the active area quickly increases itself upon the raising of the annular, coiled, valve spring 9, the cylinder side active areas quickly equalize those active areas of the plenum side, whereby the pressure port 7 once again closes against a substantially reduced closure pressure.

The piston 4 possesses in its base a connection boring 32, which is covered over by a valve body 19 of a check valve 18. This has on its circumference, a flared rim 24, with which it lies against the inner side of the piston base and is loaded by the piston spring 12 and so fixed in place. Axially opposite the connection boring 32 is to be found a valve boring 20 with a valve seat 21, against which a valve spring presses a closure element 22 in the form of a sphere. If the pressure in cylinder 5 exceeds the opening spring 23 pressure at the closure element 22, then this opens against the force of the valve spring 23 and against the thereupon acting acceleration forces, so that the pressure peaking in cylinder 5 is alleviated and simultaneously, a pressure buffer is created between the piston 4 and the bearing shell 16 in which the cam 14 operates.

The said pressure buffer transmits the loading peaks, in a damped condition, to the bearing shell and to the cam 14, whereby the emanation of noise is reduced.

The valve spring 23 can be dispensed with, if the weight of the closure element is so designed, that acceleration forces suffice for the proper profiling of the pressure curve. FIG. 3 shows, plotted against an abscissa of the angle $\phi$ of rotation of the cam, a curve for thrust 27 of a piston 4, a curve for speed 28 and an acceleration curve 29. The upper dead point of the thrust curve 27 is indicated by 30 and the lower dead point is designated 31. FIG. 3 shows the mathematical relationships between the piston 4 and its acceleration, wherein the acceleration curve 27 is displaced at an angle $\phi$ of 180° from the thrust curve 27.

| Reference numerals | |
|---|---|
| 1 | radial piston pump |
| 2 | pump body |
| 3 | pump housing |
| 4 | piston |
| 5 | cylinder |
| 6 | plug |
| 7 | pressure port |
| 8 | hollow space |
| 9 | coil type valve spring |
| 10 | collection space (plenum) |
| 11 | connection fitting (in-out) |
| 12 | piston spring |
| 13 | drive shaft |
| 13 | cam |
| 15 | damping ring |
| 16 | bearing shell |
| 17 | suction side inlet |
| 18 | pressure relief valve |
| 19 | valve body |

-continued

| Reference numerals | |
|---|---|
| 20 | valve boring |
| 21 | valve seat |
| 22 | closure element (here sphere) |
| 23 | valve spring |
| 24 | rim (bottom rim) |
| 25 | direction fo rotation (see arrow) |
| 26 | thrust disks (encase cam) |
| 27 | thrust curve (see FIG. 3) |
| 28 | speed curve (see FIG. 3) |
| 29 | acceleration curve (see FIG. 3) |
| 30 | upper dead point |
| 31 | lower dead point |
| 32 | connection boring |
| ϕ | angle of rotation |

What is claimed is:

1. A radial piston pump (1) comprising:

a pump body (2) in which pistons (4) and cylinders (5) are arranged in a radial array about a cam (14);

wherein upon a radially inward movement of the piston (4), the piston (4) draws a fluid through at least one pressure port (7) and into the corresponding cylinder (5);

upon a radially outward movement of the piston (4), the piston (4) conveys the fluid through a check valve (9) and a pressure port (7) in an outer end wall (6) of the cylinder (5) and into a plenum (10);

each piston (4) includes a connection bore (32) located in the base of the piston (4) and connecting between the corresponding cylinder (5) and the cam (14), and each connection bore (32) includes an associated pressure relief valve (18); and when a pressure in the cylinder (5) exceeds an opening pressure of the pressure relief valve (18), the fluid flows through the pressure relief valve (18) and to the cam (14) to reduce a pressure peak in the cylinder (5) and to provide a fluid buffer between the base of the piston (4) and the cam (14).

2. The radial piston pump (1) in accordance with claim 1, wherein each piston (4) further includes:

a hollow interior space (8) open towards the pressure port (7); and a valve body (19) including a valve bore (20) extending between the hollow interior space (8) and the corresponding plenum (10) and a valve seat (21) coacting with a closure element (22) to close the valve bore (20) in the direction of the hollow space (8).

3. The radial piston pump (1) in accordance with claim 2, wherein at least one of the valve bore (20) and the connection bore (32) is orifice.

4. The radial piston pump (1) in accordance with claim 2, wherein the valve body (19) lies on the base of the piston (4) with an outward flared rim (24) which anchors one end of a piston spring (12).

5. A radial piston pump (1) comprising:

a pump body (2) in which pistons (4) and cylinders (5) are arranged in a radial array about a cam (14);

wherein upon a radially inward movement of the piston (4), the piston (4) draws a fluid through at least one pressure port (7) and into the corresponding cylinder (5), and upon a radially outward movement of the piston (4), the piston (4) conveys the fluid through a check valve (9) and a pressure port (7) in an outer end wall (6) of the cylinder (5) and into a plenum (10); each piston (4) includes a connection bore (32) located in the base of the piston (4) and connecting between the corresponding cylinder (S) and the cam (14), and each connection bore (32) includes an associated pressure relief valve (18), and wherein when a pressure in the cylinder (5) exceeds an opening pressure of the pressure relief valve (18) the fluid flows through the pressure relief valve (18) and to the cam (14) to reduce a pressure peak in the cylinder (5) and to provide a fluid buffer between the base of the piston (4) and the cam (14); and radial acceleration forces resulting from radial movement of a piston (4) due to rotation of the cam (14) act upon the closure element (22) of the corresponding pressure relief valve (18) to open the pressure relief valve (18) after movement of the piston (4) due to rotation of the cam (14) passes a radially lower dead point of piston (4) movement and to close the closure element (22) of the pressure relief valve (18) after movement of the piston (4) due to rotation of the cam (14) passes a radially upper dead point of piston (4) movement.

6. The radial piston pump (1) in accordance with claim 5, wherein:

the radial acceleration forces acting on the closure element (22) of a piston (4) in a region about the radially upper dead point of the piston (4) movement exceeds a fluid pressure force in the corresponding cylinder (5) acting on the closure element (22) so that the valve bore (20) is closed during radially outward movement of the piston (4) and the fluid pressure force in the corresponding cylinder (5) exceeds the radial acceleration forces acting on the closure element (22) of the piston (4) in a region about the radially lower dead point of the piston (4) movement so that the valve bore (20) is open during radially inward movement of the piston (4).

7. The radial piston pump (1) in accordance with claim 5, wherein the radial piston pump (1) further comprises a valve spring (23) biasing the closure element (22) towards the closed position.

* * * * *